US008807945B2

(12) United States Patent
Spangler et al.

(10) Patent No.: US 8,807,945 B2
(45) Date of Patent: Aug. 19, 2014

(54) COOLING SYSTEM FOR TURBINE AIRFOIL INCLUDING ICE-CREAM-CONE-SHAPED PEDESTALS

(75) Inventors: Brandon W. Spangler, Vernon, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 611 days.

(21) Appl. No.: 13/166,369

(22) Filed: Jun. 22, 2011

(65) Prior Publication Data

US 2012/0328450 A1 Dec. 27, 2012

(51) Int. Cl.
*F01D 5/18* (2006.01)

(52) U.S. Cl.
USPC .... 416/97 R; 416/96 R; 416/97 A; 416/96 A; 415/115

(58) Field of Classification Search
USPC .... 416/97 R, 96 R, 7 A, 96 A, 97 A; 415/115
See application file for complete search history.

(56) References Cited

U.S. PATENT DOCUMENTS

| | | | | |
|---|---|---|---|---|
| 4,515,526 | A | 5/1985 | Levengood | |
| 4,786,233 | A | 11/1988 | Shizuya et al. | |
| 5,246,341 | A | 9/1993 | Hall et al. | |
| 5,288,207 | A | 2/1994 | Linask | |
| 5,361,828 | A | 11/1994 | Lee et al. | |
| 5,368,441 | A | 11/1994 | Sylvestro et al. | |
| 5,462,405 | A * | 10/1995 | Hoff et al. | 416/97 R |
| 5,538,394 | A | 7/1996 | Inomata et al. | |
| 5,738,493 | A | 4/1998 | Lee et al. | |
| 5,772,397 | A | 6/1998 | Morris et al. | |
| 6,139,269 | A * | 10/2000 | Liang | 416/97 R |
| 6,227,804 | B1 | 5/2001 | Koga et al. | |
| 6,234,754 | B1 | 5/2001 | Zelesky et al. | |
| 6,254,334 | B1 | 7/2001 | LaFleur | |
| 6,290,462 | B1 | 9/2001 | Ishiguro et al. | |
| 6,402,470 | B1 | 6/2002 | Kvasnak et al. | |
| 6,446,710 | B2 | 9/2002 | Beeck et al. | |
| 6,595,750 | B2 | 7/2003 | Parneix et al. | |
| 6,890,153 | B2 | 5/2005 | Demers et al. | |
| 6,890,154 | B2 | 5/2005 | Cunha | |
| 7,163,373 | B2 | 1/2007 | Liang | |
| 7,246,999 | B2 * | 7/2007 | Manning et al. | 416/97 R |
| 7,438,527 | B2 | 10/2008 | Albert et al. | |
| 7,513,745 | B2 * | 4/2009 | Abdel-Messeh et al. | 416/96 R |
| 7,607,891 | B2 | 10/2009 | Cherolis et al. | |
| 7,637,720 | B1 | 12/2009 | Liang | |
| 7,665,968 | B2 * | 2/2010 | Mongillo et al. | 416/97 R |
| 7,695,246 | B2 | 4/2010 | Cunha et al. | |

FOREIGN PATENT DOCUMENTS

| | | | |
|---|---|---|---|
| JP | 2000-282804 | A | 10/2000 |

* cited by examiner

*Primary Examiner* — Igor Kershteyn
(74) *Attorney, Agent, or Firm* — Kinney & Lange, P.A.

(57) ABSTRACT

A turbine airfoil comprises a wall portion, a cooling channel, a plurality of trip strips and a plurality of pedestals. The wall portion comprises a leading edge, a trailing edge, a pressure side and a suction side. The cooling channel is for receiving cooling air and extends radially through an interior of the wall portion between the pressure side and the suction side. The plurality of trip strips line the wall portion inside the cooling channel along the pressure side and the suction side. Each of the pedestals is an elongate, tapered pedestal having a curved leading edge. The plurality of pedestals is interposed within the trip strips and connects the pressure side with the suction side.

30 Claims, 4 Drawing Sheets

COOLING SYSTEM FOR TURBINE AIRFOIL INCLUDING ICE-CREAM-CONE-SHAPED PEDESTALS

BACKGROUND

Gas turbine engines operate by passing a volume of high energy gases through a plurality of stages of vanes and blades, each having an airfoil, in order to drive turbines to produce rotational shaft power. The shaft power is used to turn a turbine for driving a compressor to provide air to a combustion process to generate the high energy gases. Additionally, the shaft power is used to power a secondary turbine to, for example, drive a generator for producing electricity, or to produce high momentum gases for producing thrust. In order to produce gases having sufficient energy to drive both the compressor and the secondary turbine, it is necessary to combust the air at elevated temperatures and to compress the air to elevated pressures, which again increases the temperature. Thus, the vanes and blades are subjected to extremely high temperatures, often times exceeding the melting point of the alloys comprising the airfoils.

In order to maintain the airfoils at temperatures below their melting point it is necessary to, among other things, cool the airfoils with a supply of relatively cooler bypass air, typically siphoned from the compressor. The bypass cooling air is directed into the blade or vane to provide impingement and film cooling of the airfoil. Specifically, the bypass air is passed into the interior of the airfoil to remove heat from the alloy, and subsequently discharged through cooling holes to pass over the outer surface of the airfoil to prevent the hot gases from contacting the vane or blade. Various cooling air patterns and systems have been developed to ensure sufficient cooling of the trailing edges of blades and turbines.

Typically, each airfoil includes a plurality of interior cooling channels that extend through the airfoil and receive the cooling air. The cooling channels typically extend straight through the airfoil from the inner diameter end to the outer diameter end such that the air passes out of the airfoil. In other embodiments, a single serpentine cooling channel winds axially through the airfoil. Cooling holes are placed along the leading edge, trailing edge, pressure side and suction side of the airfoil to direct the interior cooling air out to the exterior surface of the airfoil for film cooling. In order to improve cooling effectiveness, the cooling channels are typically provided with trip strips and pedestals to improve heat transfer from the airfoil to the cooling air. Trip strips, which typically comprise small surface undulations on the airfoil walls, are used to promote local turbulence and increase cooling. Pedestals, which typically comprise cylindrical bodes extending between the airfoil walls, are used to provide partial blocking of the passageway to control flow. Various shapes, configurations and combinations of trip strips and pedestals have been used in an effort to increase turbulence and heat transfer from the airfoil to the cooling air. However, pedestals used at the same location as trip strips, such as in U.S. Pat. No. 6,290,462 to Ishiguro et al., produce dead zones in the cooling air flow that interferes with the effectiveness of the trip strips. Pedestals are therefore typically positioned several lengths upstream or downstream of trip strips, such as disclosed in U.S. Pat. No. 5,288,207 to Linask. There is a continuing need to improve cooling of turbine airfoils to increase the temperature to which the airfoils can be exposed to increase the efficiency of the gas turbine engine.

SUMMARY a turbine airfoil comprises a wall portion, a cooling channel, a plurality of trip strips and a plurality of pedestals. The wall portion comprises a leading edge, a trailing edge, a pressure side and a suction side. The cooling channel is for receiving cooling air and extends radially through an interior of the wall portion between the pressure side and the suction side. The plurality of trip strips line the wall portion inside the cooling channel along the pressure side and the suction side. Each of the pedestals is an elongate, tapered pedestal having a curved leading edge. The plurality of pedestals is interposed within the trip strips and connects the pressure side with the suction side.

DETAILED DESCRIPTION

Figure 1:
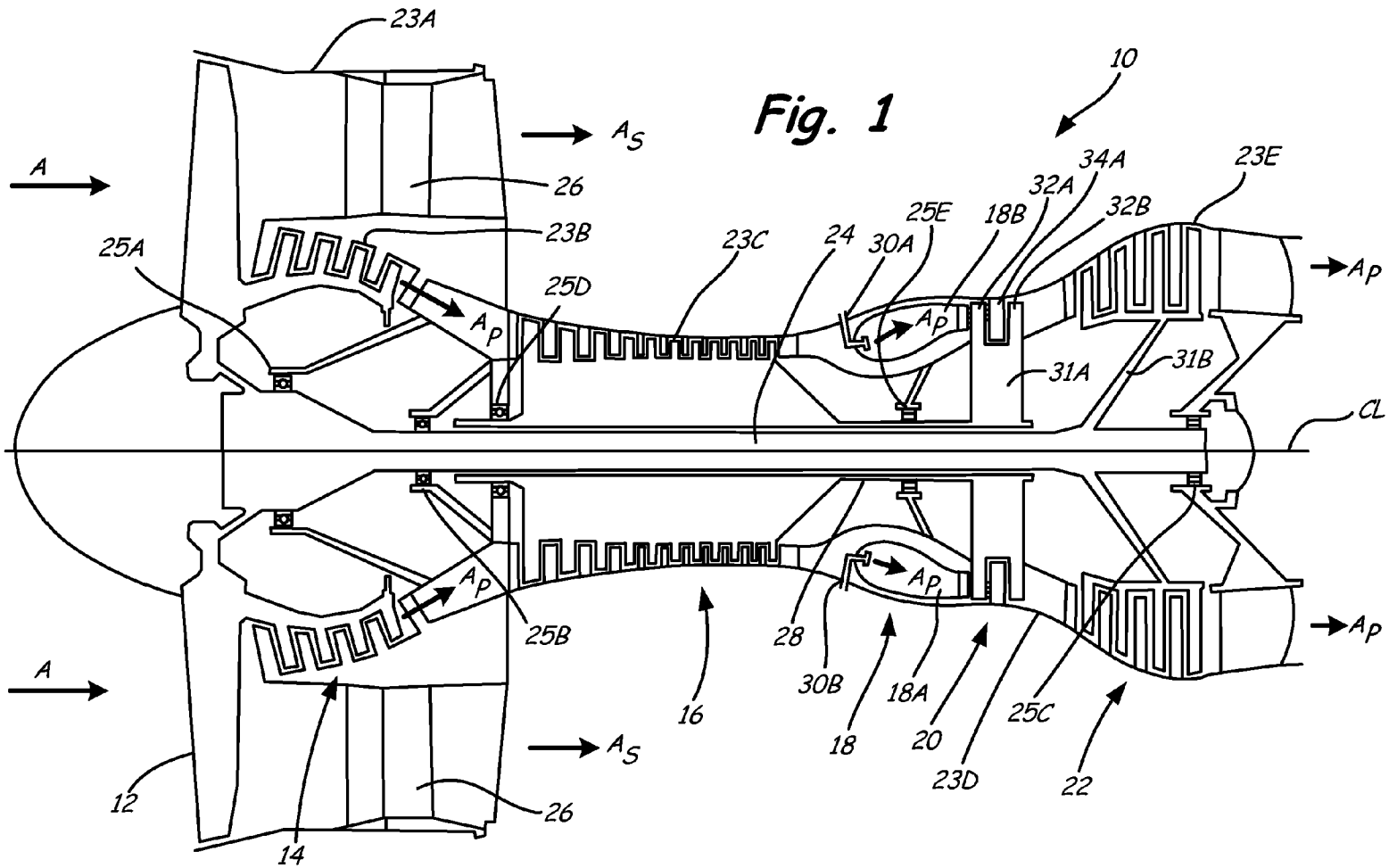
FIG. 1 shows a gas turbine engine including a turbine section in which blades having the cooling system of the present invention is used.

FIG. 1 shows gas turbine engine 10, in which the pedestals of the present invention are used. Gas turbine engine 10 comprises a dual-spool turbofan engine having fan 12, low pressure compressor (LPC) 14, high pressure compressor (HPC) 16, combustor section 18, high pressure turbine (HPT) 20 and low pressure turbine (LPT) 22, which are each concentrically disposed around longitudinal engine centerline CL. Fan 12 is enclosed at its outer diameter within fan case 23A. Likewise, the other engine components are correspondingly enclosed at their outer diameters within various engine casings, including LPC case 23B, HPC case 23C, HPT case 23D and LPT case 23E such that an air flow path is formed around centerline CL.

Inlet air A enters engine 10 and it is divided into streams of primary air $A_P$ and secondary air $A_S$ after it passes through fan 12. Fan 12 is rotated by low pressure turbine 22 through shaft 24 to accelerate secondary air $A_S$ (also known as bypass air) through exit guide vanes 26, thereby producing a major portion of the thrust output of engine 10. Shaft 24 is supported within engine 10 at ball bearing 25A, roller bearing 25B and roller bearing 25C. Primary air $A_P$ (also known as gas path air) is directed first into low pressure compressor (LPC) 14 and then into high pressure compressor (HPC) 16. LPC 14 and HPC 16 work together to incrementally step up the pressure of primary air $A_P$. HPC 16 is rotated by HPT 20 through shaft 28 to provide compressed air to combustor section 18. Shaft 28 is supported within engine 10 at ball bearing 25D and roller bearing 25E. The compressed air is delivered to combustors 18A and 18B, along with fuel through injectors 30A and 30B, such that a combustion process can be carried out to produce the high energy gases necessary to turn turbines 20 and 22, as is known in the art. Primary air $A_P$ continues through gas turbine engine 10 whereby it is typically passed through an exhaust nozzle to further produce thrust.

HPT 20 and LPT 22 each include a circumferential array of blades extending radially from discs 31A and 31B connected to shafts 28 and 24, respectively. Similarly, HPT 20 and LPT 22 each include a circumferential array of vanes extending radially from HPT case 23D and LPT case 23E, respectively. Specifically, HPT 20 includes blades 32A and 32B and vane 34A. Blades 32A and 32B include internal passages into which compressed air from, for example, LPC 14 is directed to provide cooling relative to the hot combustion gasses. Cooling systems of the present invention include ice-cream-cone-shaped pedestals to increase heat transfer from blades 32A and 32B to the cooling air, specifically at the trailing edge. However, the cooling system of the present invention can be used at other positions within blades 32A and 32B or within vane 34A.

Figure 2:
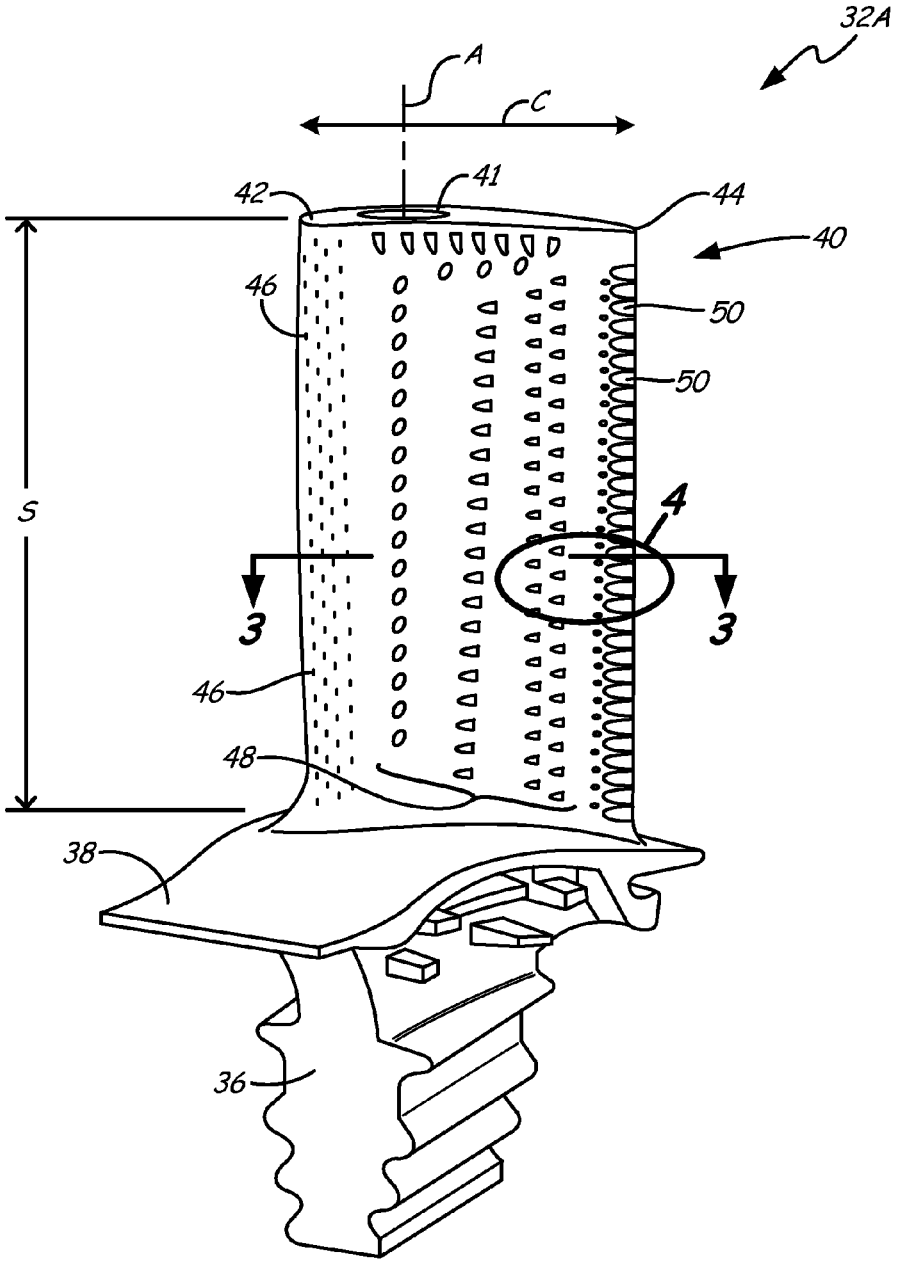
FIG. 2 is a perspective view of a blade used in the turbine section of FIG. 1.

FIG. 2 is a perspective view of blade 32A of FIG. 1. Blade 32A includes root 36, platform 38 and airfoil 40. Span S of airfoil 40 extends radially from platform 38 along axis A to tip 41. Airfoil 40 extends generally axially along platform 38 from leading edge 42 to trailing edge 44 across chord length C. Airfoil 40 is, however, curved to form a pressure side and a suction side, as is known in the art. Root 36 comprises a dovetail or fir tree configuration for engaging disc 31A (FIG. 1). Platform 38 shrouds the outer radial extent of root 36 to separate the gas path of HPT 20 from the interior of engine 10 (FIG. 1). Airfoil 40 extends from platform 38 to engage the gas path. Airfoil 40 includes leading edge cooling holes 46, pressure side cooling holes 48 and trailing edge slots 50. Although not shown, airfoil 40 also includes suction side cooling holes. Typically, cooling air is directed into the radially inner surface of root 36 from, for example, HPC 16 (FIG. 1). The cooling air exits blade 32A through one of the many cooling holes or slots located therein after passing through internal cooling channels. The cooling air may also exit blade 32A at an opening in tip 41.

Figure 3:
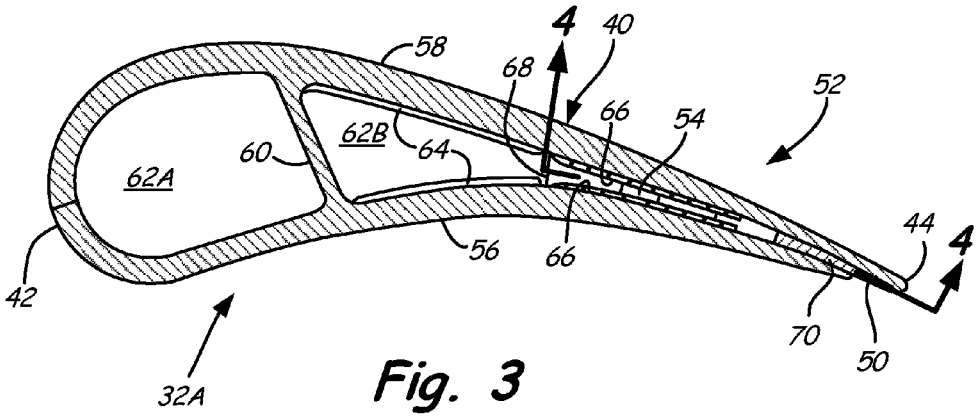
FIG. 3 is a top cross-sectional view of the blade of FIG. 2 showing a trailing edge cooling system having ice-cream-cone-shaped pedestals.

FIG. 3 is a top cross-sectional view of blade 32A of FIG. 2 showing cooling system 52 having ice-cream-cone-shaped pedestals 54 located near trailing edge 44. Airfoil 40 comprises a thin-walled structure that forms a hollow cavity having leading edge 42, trailing edge 44, pressure side 56 and suction side 58. Partition 60 extends between pressure side 56 and suction side 58 to form channels 62A and 62B and provide structural support to airfoil 40. Channel 62B includes trip strips 64 and is adjacent trailing edge cooling system 52. Cooling system 52 includes pedestals 54, trip strips 66, rib 68, slots 50 and trailing edge fins 70. Although described with respect to generally axially extending pedestals located near trailing edge 44, the present invention may be used in other portions of the airfoil 40. For example, pedestals may extend radially between pressure side 56 and suction side 58 within channel 62A.

Trip strips 64, which are diagrammatically shown in FIG. 3, may comprise any conventional trip strip configuration that is known in the art. Trip strips 66 are aft of trip strips 64 and configured to interact with other components of trailing edge cooling system 52. Trip strips 66 comprise two columns, one extending radially along pressure side 56 and one extending radially along suction side 58. Trip strips 66 can have various specific geometries to tune cooling air flowing axially along rib 68. As discussed in greater detail with respect to FIG. 4, trip strips 66 comprise chevron shaped strips arranged between adjacent ribs 68 in one embodiment of the invention. Rib 68 comprises one of a plurality of axially stacked, solid, elongate projections extending between pressure side 56 and suction side 58. Rib 68 is configured to guide air from channel 62B axially aftward toward trailing edge slots 50. Trip strips 66 cover a sufficient amount of pressure side 56 and suction side 58 to envelop ribs 68; trip strips 66 extend from the leading edge of ribs 68 and axially aft past the trailing edge of ribs 68.

Pedestals 54 also comprise solid projections extending between pressure side 56 and suction side 58. Pedestals 54 are, however, configured to block airflow between ribs 68, thereby reducing airflow to selected parts of airfoil 40. Specifically, pedestals 54 create blockage within the flow of cooling air to locally lower pressure and reduce flow. As discussed below with reference to FIG. 4, pedestals 54 are ice-cream-cone-shaped to reduce the formations of wakes within the airflow between ribs 68. Pedestals 54 may also have other teardrop-like shapes, as discussed with reference to FIG. 5. Trailing edge fins 70 also comprise solid projections extending between pressure side 56 and suction side 58. However, pressure side 56 is cut back, or axially shorter than suction side 58, so as to not join with suction side 58 at trailing edge 44, thereby forming slots 50. Trailing edge fins are positioned downstream of ribs 68 and configured to guide cooling air out of airfoil 40.

In the described embodiment, airfoil 40 comprises a high pressure turbine blade that is positioned downstream of combustors 18A and 18B of gas turbine engine 10 to impinge primary air $A_P$ (FIG. 1). Due to the extremely elevated temperatures of primary air $A_P$, it is necessary to employ means for cooling blade 32A. As such, cooling air can be directed into airfoil 40, such as from root 36 (FIG. 2) to flow through channels 62A and 62B. Cooling channels 62A and 62B and partition 60 form a cooling network within airfoil 40. In the embodiment shown, channels 62A and 62B extend generally straight through airfoil 40 from platform 38 to tip 41. In other embodiments, channels 62A and 62B can be connected in a serpentine fashion as is known in the art. Cooling air within channel 62A flows through airfoil 40 and exits at tip 41, leading edge cooling holes 46, some of pressure side cooling holes 48 and some suction side cooling holes (See FIG. 2). Some of the cooling air within channel 62B flows through airfoil 40 and exits through suction side cooling holes and pressure side cooling holes 48, while the remaining cooling air flows out of blade 32A through trailing edge cooling system 52. With specific reference to FIG. 3, the cooling air travels axially across trip strips 66, radially outward of rib 68, and above and below pedestal 54. From there the cooling air is divided radially by trailing edge fin 70 for passage through trailing edge slot 50.

Figure 4:
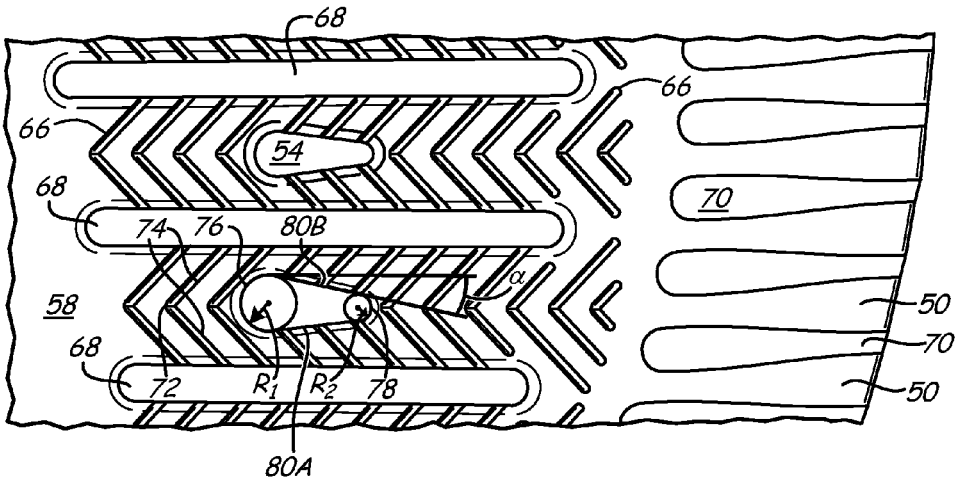
FIG. 4 is a partially broken away side view of the blade, as taken at callout 4 of FIG. 2 and section 4-4 of FIG. 3, showing the ice-cream-cone-shaped pedestals positioned between axial ribs and within trip strips.

FIG. 4 is a partially broken away side view of blade 32A of FIG. 2, as taken at callout 4. Specifically, a portion of pressure side 56 within callout 4 is removed from airfoil 40 to show slots 50, ice-cream-cone-shaped pedestals 54, trip strips 66, ribs 68 and fins 70.

Trip strips 66 are provided along suction side 56. In the disclosed embodiment, trip strips 66 are arranged as arrays of radially extending zigzag-shaped trip strips that extend across the radial extent of airfoil 40. Ribs 68 extend across trip strips 66 such that the two intersect. In other words, trip strips 66 are arranged in a plurality of rows of chevron-shaped trip strips that extend axially between ribs 68. Tips of the chevrons are pointed in an upstream direction. Trip strips 66 promote heat transfer from airfoil 40 to cooling air. Specifically, trip strips 66 produce vortices that create turbulence in the cooling air that increases the residency time of contact between airfoil 40 and the cooling air. Thus, trip strips 66 increase the local convective heat transfer coefficient and thermal cooling effectiveness of the cooling air by increasing mixing of cooling air with the boundary layer air along the interior wall of airfoil 40. Additionally, trip strips 66 increase the internal surface area of channel 62B, which allows for additional convective heat transfer from airfoil 40 to the cooling air.

The combination of pedestals 54 and ribs 68 improve the performance of trip strips 66. As mentioned, pedestals are used to provide blockage between adjacent ribs 68 to reduce flow of cooling air. For example, pedestals are used to produce proper pressure differentials within airfoil 40 to induce flow of the cooling air through cooling holes 48 on pressure side 56. Pedestals 54 provide a degree of heat transfer enhancement by producing a large wake. In conventional round pedestals, however, this wake produces undesirable dead zones into flow of the cooling air that reduces heat transfer effectiveness of the trip strips. Specifically, round pedestals impede the ability of trip strips to produce vortices that fill in the space between adjacent trip strips and behind the pedestal. Ice-cream-cone-shaped pedestals 54 of the present invention reduce such detrimental dead zones by keeping the flow of cooling air attached to the rear or downstream portion of the pedestals.

Ribs 68 guide cooling air from channel 62B through the aft portion of airfoil 40 so that the air can be discharged through trailing edge slots 50. Ribs 68 extend generally in an axial direction with respect to the centerline of engine 10. Ribs 68 guide the cooling air into the correct interaction with trip strips 66. In the embodiment shown, trip strips 66 are chevron-shaped. Chevron-shaped trip strips 66 are most effective at heat transfer when cooling air travels straight across the trip strips. Thus, adjacent ribs 68 are parallel and tips 72 of the chevrons of trip strips 66 are positioned midway between the ribs, with legs 74 of the chevrons extending axially downstream with equal radial and axial vector components. In the embodiment shown, legs 74 form an angle of approximately 105 degrees between them. Trip strips 66 typically extend about fifteen-thousandths of an inch (~0.381 millimeters) from suction side 58. Likewise, legs 74 of trip strips 66 are typically about fifteen-thousandths of an inch (~0.381 millimeters) wide.

Pedestals 54 are ice-cream-cone-shaped or teardrop-shaped. As depicted in FIG. 4, pedestals 54 include leading edge wall 76, trailing edge wall 78 and side walls 80A and 80B. Leading edge wall 76 has a first radius of curvature $R_1$ so as to produce a rounded leading edge. Trailing edge wall 78 has a second radius of curvature $R_2$ so as to produce a rounded trailing edge. Radius of curvature $R_2$ is less than the first radius of curvature $R_1$. Side walls 80A and 80B are longer than the distance between side walls 80A and 80B at all points such that pedestal 54 has an elongate shape. Side walls 80A and 80B extend straight between rounded leading edge wall 76 and rounded trailing edge wall 78. In the depicted embodiments pedestal 54 is tapered along the entire length between the leading and trailing edges, but need not be in every embodiment. Side walls 80A and 80B are tangent with the circles of leading edge wall 76 and trailing edge wall 78. As such, side walls 80A and 80B converge toward each other as they extend from leading edge wall 76 to trailing edge wall 78. Each pedestal 54 is thus provided with a decreasing height as it extends from its leading edge to its trailing edge. In other words, the distance between side walls 80A and 80B near leading edge 76 is larger than the distance between side walls 80A and 80B near trailing edge 78. In one embodiment, radius of curvature $R_2$ is smaller than radius of curvature $R_1$ such that diffusion angle $\alpha$ is about 5 to about 10 degrees. This diffusion angle $\alpha$ reduces the wake behind pedestal 54, maintaining straight channel flow of the cooling air between ribs 68. Diffusion angles $\alpha$ above 10 degrees tend to result in detachment of the cooling air flow as it wraps around the pedestal, similar to that of a round pedestal, thereby resulting in undesirable turbulence dead zones.

Figure 5:
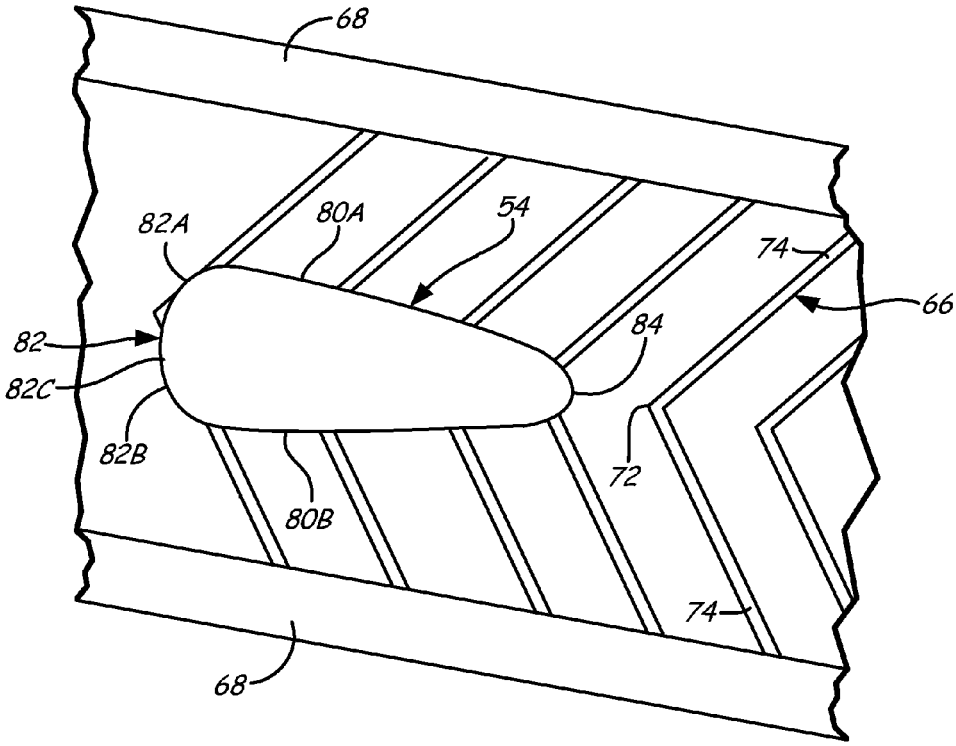
FIG. 5 is side view of the ice-cream-cone-shaped pedestal of FIG. 4 having an alternative geometry.

FIG. 5 is an alternative side view of ice-cream-cone-shaped pedestal 54 of FIG. 4. FIG. 5 includes similar structure as that shown in FIG. 4, with like elements having the same reference numeral. In FIG. 5, however, pedestal 54 has an alternative geometry.

The leading edge wall and the trailing edge wall need not have a true circular configuration as in FIG. 4 to achieve the desired result of the present invention. As discussed above, diffusion angle $\alpha$ resulting from the difference between radii of curvature $R_1$ and $R_2$ reduces the wake produced by pedestal 54 in the flow of cooling air. Curvature of the leading edge of pedestal 54 assists in producing this result by smoothly penetrating flow of the cooling air and therefore may be circular, blunted, elliptical, parabolic or have some other radius of curvature. Gradual reduction in the height of pedestal 54 from leading edge to trailing edge avoids formation of the aforementioned dead zones by keeping the cooling air flow attached. To that end, the trailing edge of pedestal 54 could come to a point to further avoid production of the dead zone. However, due to manufacturing considerations, the trailing edge of pedestal 54 may be circular, blunted, elliptical, parabolic or have some other radius of curvature.

In FIG. 5, leading edge wall 82 is blunted and trailing edge wall 84 is elliptical. Leading edge wall 82 includes circular portions 82A and 82B, with a simple curved portion 82C between. Curved portion 82C has a larger radius of curvature than portions 82A and 82B, giving a blunted configuration. In other embodiments, portion 82C may comprise a flat section of small width and portions 82A and 82B may have some other curvature. Trailing edge wall 84 simply comprises an elliptical profile. Pedestal 54 may, in other embodiments, be provided with blunted leading and trailing edges, elliptical leading and trailing edges or any combination of the two. In any embodiment, sidewalls 82A and 82B connect the arcuate leading edge wall and arcuate trailing edge wall in a tangential, straight-line manner. Generally speaking, an ice-cream-cone-shaped or teardrop-shaped pedestal 54 of the present invention comprises an elongate, tapered pedestal with a curved or arcuate leading edge.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine airfoil comprising:

a wall portion comprising:

a leading edge;

a trailing edge;

a pressure side; and a suction side;

a cooling channel for receiving cooling air extending radially through an interior of the wall portion between the pressure side and the suction side;

a plurality of trip strips lining the wall portion inside the cooling channel along the pressure side and the suction side; and a plurality of elongate, tapered pedestals having curved leading edges interposed within the trip strips and connecting the pressure side with the suction side.

2. The turbine airfoil of claim 1 wherein the pedestals are ice-cream-cone-shaped.

3. The turbine airfoil of claim 1 wherein the ice-cream-cone-shaped pedestals comprise:

a rounded leading edge having a first radius of curvature;

a rounded trailing edge having a second radius of curvature less than the first radius of curvature; and first and second tangent edges extending straight between the rounded leading edge and the rounded trailing edge.

4. The turbine airfoil of claim 3 wherein:

the rounded leading edge is partially blunted at a tip of the leading edge along a portion of a circumference of the first radius of curvature; and the rounded trailing edge is partially blunted at a tip of the trailing edge along a portion of a circumference of the second radius of curvature.

5. The turbine airfoil of claim 1 wherein each ice-cream-cone-shaped pedestal extends between a leading edge and a trailing edge of the pedestal, the pedestal decreasing in radial height as the pedestal extends from the leading edge to the trailing edge.

6. The turbine airfoil of claim 5 wherein the ice-cream-cone-shaped pedestals comprise:

an arcuate leading edge wall;

an arcuate trailing edge wall; and first and second side edge walls extending straight between the rounded leading edge wall and the rounded trailing edge wall.

7. The turbine airfoil of claim 6 wherein the arcuate leading edge and the arcuate trailing edge are parabolic or elliptical.

8. The turbine airfoil of claim 1 and further comprising a plurality of ribs extending generally axially and positioned radially between adjacent ice-cream-cone-shaped pedestals.

9. The turbine airfoil of claim 8 wherein the plurality of trip strips comprise:

a first array of zigzag shaped trip strips extending in a radial direction along the suction side; and a second array of zigzag shaped trip strips extending in a radial direction along the pressure side;

wherein the first and second arrays of zigzag trip strips extend through the plurality of ribs.

10. The turbine airfoil of claim 8 wherein the plurality of trip strips comprise:

a first plurality of rows of chevron shaped trip strips extending radially between adjacent ribs on the suction side; and a second plurality of rows of chevron shaped trip strips extending radially between adjacent ribs on the pressure side.

11. The turbine airfoil of claim 8 and further comprising a plurality of fins disposed at the trailing edge of the wall portion and connecting the pressure side and the suction side to form a plurality of trailing edge slots.

12. A turbine airfoil comprising:

a wall having a leading edge, a trailing edge, a pressure side, a suction side, an outer diameter end and an inner diameter end to define an interior chamber;

a divider extending radially between the inner diameter end and the outer diameter end of the wall within the interior chamber to define a cooling channel; and a trailing edge cooling system positioned downstream of the cooling channel, the trailing edge cooling system including:

a first grouping of trip strips lining the pressure side;

a second grouping of trip strips lining the suction side; and a plurality of teardrop-shaped pedestals interposed within the trip strips, connected to the pressure side and the suction side, oriented generally in an axial direction, and configured to receive fluid flow from the cooling channel.

13. The turbine airfoil of claim 12 wherein the trailing edge cooling system further comprises:

a plurality of ribs connected to the pressure side and suction side and extending generally in an axial direction and positioned radially between adjacent teardrop-shaped pedestals.

14. The turbine airfoil of claim 13 wherein the trailing edge cooling system further comprises:

a plurality of fins connected to the pressure side and the suction side and oriented generally in an axial direction and positioned downstream of the plurality of teardrop-shaped pedestals so as to be configured to receive fluid flow from the teardrop-shaped pedestals.

15. The turbine airfoil of claim 13 wherein each grouping of trip strips comprises zigzag shaped trip strips extending radially across the ribs and teardrop-shaped pedestals.

16. The turbine airfoil of claim 13 wherein each grouping of trip strips comprises a plurality of rows of chevron shaped trip strips positioned radially between adjacent ribs and oriented with an apex of each chevron pointed upstream.

17. The turbine airfoil of claim 12 wherein each of the teardrop-shaped pedestals comprises:

a rounded leading edge having a first radius of curvature;

a rounded trailing edge having a second radius of curvature less than the first radius of curvature; and first and second tangent edges extending straight between the rounded leading edge and the rounded trailing edge.

18. The turbine airfoil of claim 17 wherein:

the rounded leading edge is partially blunted at a tip of the leading edge along a portion of a circumference of the first radius of curvature; and the rounded trailing edge is partially blunted at a tip of the trailing edge along a portion of a circumference of the second radius of curvature.

19. The turbine airfoil of claim 12 wherein each teardrop-shaped pedestal extends between a leading edge and a trailing edge of the pedestal, the pedestal decreasing in radial height as the pedestal extends from the leading edge to the trailing edge.

20. The turbine airfoil of claim 19 wherein each of the teardrop-shaped pedestals comprises:

an arcuate leading edge wall;

an arcuate trailing edge wall; and first and second side edge walls extending straight between the rounded leading edge wall and the rounded trailing edge wall.

21. A turbine airfoil comprising:

a wall having a leading edge, a trailing edge, a pressure side, a suction side, an outer diameter end and an inner diameter end to define an interior chamber;

a divider extending radially between the inner diameter end and the outer diameter end of the wall within the interior chamber to define a cooling channel; and a trailing edge cooling system positioned downstream of the cooling channel, the trailing edge cooling system including:

a plurality of teardrop-shaped pedestals interposed within the trip strips, connected to the pressure side and the suction side, oriented generally in an axial direction, and configured to receive fluid flow from the cooling channel;

a first grouping of trip strips lining the pressure side;

a second grouping of trip strips lining the suction side; and a plurality of ribs connected to the pressure side and suction side and extending generally in an axial direction and positioned radially between adjacent teardrop-shaped pedestals.

22. The turbine airfoil of claim 21 wherein the trailing edge cooling system further comprises:

a plurality of fins connected to the pressure side and the suction side and oriented generally in an axial direction and positioned downstream of the plurality of teardrop-shaped pedestals so as to be configured to receive fluid flow from the teardrop-shaped pedestals.

23. The turbine airfoil of claim 21 wherein each grouping of trip strips comprises zigzag shaped trip strips extending radially across the ribs and teardrop-shaped pedestals.

24. The turbine airfoil of claim 21 wherein each grouping of trip strips comprises a plurality of rows of chevron shaped trip strips positioned radially between adjacent ribs and oriented with an apex of each chevron pointed upstream.

25. The turbine airfoil of claim 21 wherein each of the teardrop-shaped pedestals comprises:

a rounded leading edge having a first radius of curvature;

a rounded trailing edge having a second radius of curvature less than the first radius of curvature; and first and second tangent edges extending straight between the rounded leading edge and the rounded trailing edge.

26. The turbine airfoil of claim 25 wherein:

the rounded leading edge is partially blunted at a tip of the leading edge along a portion of a circumference of the first radius of curvature; and the rounded trailing edge is partially blunted at a tip of the trailing edge along a portion of a circumference of the second radius of curvature.

27. The turbine airfoil of claim 21 wherein each teardrop-shaped pedestal extends between a leading edge and a trailing edge of the pedestal, the pedestal decreasing in radial height as the pedestal extends from the leading edge to the trailing edge.

28. The turbine airfoil of claim 27 wherein each of the teardrop-shaped pedestals comprises:

an arcuate leading edge wall;

an arcuate trailing edge wall; and first and second side edge walls extending straight between the rounded leading edge wall and the rounded trailing edge wall.

29. A turbine airfoil comprising:

a wall having a leading edge, a trailing edge, a pressure side, a suction side, an outer diameter end and an inner diameter end to define an interior chamber;

a divider extending radially between the inner diameter end and the outer diameter end of the wall within the interior chamber to define a cooling channel; and a trailing edge cooling system positioned downstream of the cooling channel, the trailing edge cooling system including:

a plurality of teardrop-shaped pedestals interposed within the trip strips, connected to the pressure side and the suction side, oriented generally in an axial direction, and configured to receive fluid flow from the cooling channel; and a plurality of ribs connected to the pressure side and suction side and extending generally in an axial direction and position radially between adjacent teardrop-shaped pedestals.

30. The turbine airfoil of claim 29, wherein the trailing edge cooling system further comprises a plurality of rows of chevron shaped trip strips positioned on an inner wall of the pressure side and the suction side, radially between adjacent ribs and oriented with an apex of each chevron pointed upstream.

* * * * *